United States Patent [19]

Grabowski

[11] Patent Number: 4,744,098

[45] Date of Patent: May 10, 1988

[54] ROULETTE CALCULATOR

[76] Inventor: Walter A. Grabowski, 1115 The Woods, Cherry Hill, N.J. 08003

[21] Appl. No.: 923,809

[22] Filed: Oct. 27, 1986

[51] Int. Cl.[4] ..... A63B 71/06; A63F 5/00

[52] U.S. Cl. ..... 377/5; 273/148 R; 377/112

[58] Field of Search ..... 377/5, 112; 273/142 R, 273/148 R, 269; 364/410, 411, 412

[56] References Cited

U.S. PATENT DOCUMENTS

| | | | |
|---|---|---|---|
| 1,858,060 | 11/1930 | Ricci | 273/142 B |
| 2,866,601 | 12/1958 | Naber | 273/148 R |
| 4,130,871 | 12/1978 | Olsen et al. | 377/5 |
| 4,220,992 | 9/1980 | Blood et al. | 377/5 |
| 4,275,443 | 6/1981 | Sorin | 364/410 |
| 4,286,323 | 8/1981 | Meday | 364/411 |
| 4,357,659 | 11/1982 | Nathans | 377/5 |
| 4,396,193 | 8/1983 | Reinhardt et al. | 364/410 |

FOREIGN PATENT DOCUMENTS

| | | | |
|---|---|---|---|
| 0151376 | 8/1985 | European Pat. Off. | 273/148 R |
| 934315 | 10/1955 | Fed. Rep. of Germany | 377/5 |
| 2711796 | 9/1978 | Fed. Rep. of Germany | 377/5 |
| 3307864 | 4/1984 | Fed. Rep. of Germany | 364/412 |
| 7907317 | 11/1980 | France | 273/148 R |
| 2534481 | 4/1984 | France | 273/148 R |

*Primary Examiner*—John S. Heyman

*Attorney, Agent, or Firm*—Charles F. Duffield

[57] ABSTRACT

A roulette calculator for recording and visually displaying the occurrence and number of winning numerals during the progress of play of a roulette game is disclosed. The calculator includes a keyboard having a key and visual display for each number of a roulette wheel. A power source and electronic circuit means are employed between the keys and visual display means to advance the count in the visual display means upon key stroke of a given key to thus visually display winning numerals and the number of times that numeral was a winning numeral. The layout of the keyboard and color of the keys correspond to the roulette table colors and layout. Additional keys and associated visual displays may be provided to record conditions such as the number of winnings of red vs. black or odd vs. even. The keys and visual displays are positioned within recesses to prevent miskeying.

6 Claims, 2 Drawing Sheets

ROULETTE CALCULATOR

BACKGROUND OF INVENTION

The present invention relates to recording or tallying devices for games, and, more specifically, to a calculator for recording and visually displaying the occurrence and number of winning numbers in a roulette game.

The game of roulette employs a rotating wheel bearing a series of nonrepeating numbers about its periphery ranging from 1 through 36 with the further inclusion of a 0 and 00. The numbers vary in color between red and black with the 0 and 00 being green. The numbers on the wheel are not consecutive but are in a mixed pattern, i.e. 1, 13, 36, 24, etc. and alternate between red and black except for the green 0 and 00.

The roulette game includes a playing table which, for the principal portion thereof, includes three columns and twelve rows. The numbers 1 through 36 are displayed in the columns with the numbers 1, 2 and 3 positioned in the upper row from left to right with 4, 5 and 6 in the second row and so on to the bottom row wherein there are positioned the numbers 34, 35 and 36. At the top of the three columns there are positioned from left to right the numbers 0 and 00.

During play of the game, the wheel is spun and the ball likewise spun in a counter rotating position around an outer run in the roulette wheel. A plurality of sockets are positioned adjacent the numbers on an inner run of the roulette wheel. As the ball slows, the ball will fall to the inner portion of the roulette wheel and lodge in a socket adjacent a given number. The socket within which the ball lodges then is the determination of the winning color and winning number.

Prior to the commencement of spinning of the wheel and ball, a player who has been assigned a specific color of chips will place his bet upon a given number or, if desired, across lines between two or four numbers. If the ball lodges in a socket for one of the numbers bet upon by the player or of a particular color bet upon by the player in another variation of the game, that particular player wins.

During play of the roulette game, certain numbers, colors or conditions of odd vs. even numbers tend to come up more frequently than others during different periods of play. Some players, therefore, wish to use this apparent variation in repetition of certain numbers, colors or odd vs. even as a basis for predicting the performance of the wheel for subsequent plays and therefore, place their bet accordingly.

At present, the only means for recording the fact that a given number has been a winner and the number of times that it has been a winner and likewise the number of times a particular color has been the winner vs. the opposite color is by means of a pencil and paper. During play, it is difficult to keep up with the game which moves rather rapidly while at the same time manually recording the winning numbers and colors.

There exists a need for a small, lightweight and convenient hand held calculator which can be easily and quickly used to record the occurrence of winning numbers and colors and the repetition rate thereof.

SUMMARY OF INVENTION

The roulette calculator of the present invention includes a keyboard arranged in three columns and twelve rows in an arrangement the same as the roulette playing table. The keys are numbered 1 through 36 and are of the color of the numbers of the roulette playing table.

Associated with and positioned beside each key is an illuminated visual display. A battery power supply is provided and works in conjunction with electronic circuit means for each key and associated visual display to illuminate the display upon the first depression of a given key and to thereafter increment the count in the visual display one integer for each additional key stroke of a given key.

Two additional keys and associated visual displays are provided and positioned above the first row of numbers. Removable decals are provided which may be placed over these latter two keys to indicate conditions such as red or black or odd or even.

The structure of the keyboard is such that the keys and associated visual displays are positioned within recesses. The recesses aid in alignment of the user's finger to prevent miskeying of other keys.

During play of the roulette game, the calculator is cleared and all visual displays brought to a nonilluminated stage. Thereafter, as successive winning numbers occur, they are entered into the calculator by depressing the corresponding key. In a like manner, the number of events of winning numbers red or black or odd or even may be entered into the two additional keys. The roulette player can then be guided in his choice of numbers or conditions to play depending on this history of the prior winning numbers.

DETAILED DESCRIPTION OF INVENTION

Figure 1:
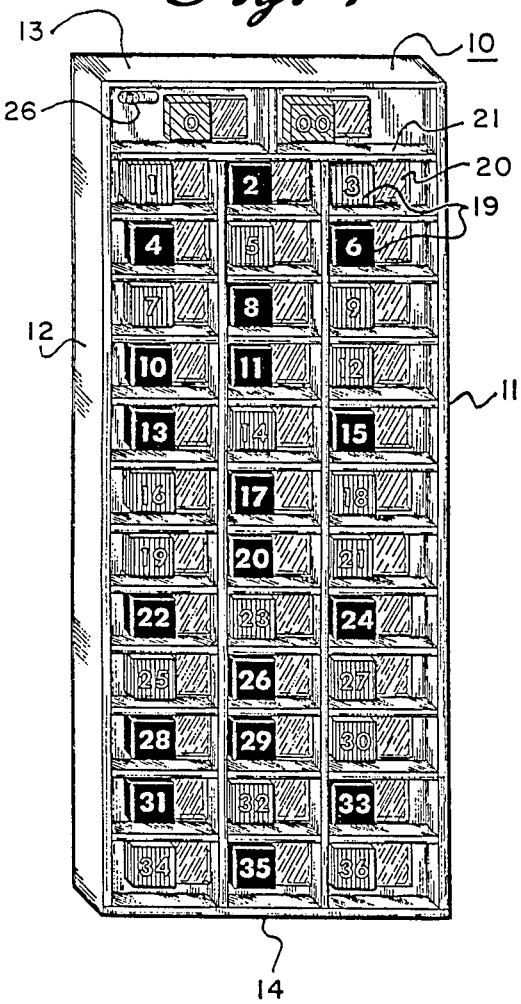
FIG. 1 is a perspective view of the roulette calculator of the present invention.

The roulette calculator of the present invention is shown in FIGS. 1–6 of the drawings. The detailed description of the roulette calculator of the present invention will be taken generally in conjunction with FIGS. 1–6 without specific reference to a given figure except in particular circumstances where it is felt more advantageous to make reference to a particular figure.

The roulette calculator includes a rectangular casing 10 having opposed side walls 11 and 12 and opposed end walls 13 and 14. A back wall 15, interconnected between the side walls and end walls, completes the casing.

Positioned within the bottom of the casing is a printed circuit board 16 which will be described more in detail hereinafter. An access panel (not shown) in the back wall 15 of the casing provides access for and storage of a small dry storage battery (not shown).

Positioned above the printed circuit board 16 and intermediate within the casing 10 is a keyboard retainer 17. The keyboard retainer 17 includes cutouts 18 therein for receipt of a plurality of keys 19 and visual displays 20 as to be described hereinafter.

The keyboard retainer 17 further includes a plurality of horizontal partition walls 21 and vertical partition walls 22. These horizontal and vertical partition walls, cooperating with one another or with the side walls 11 and 12 and end walls 13 and 14 of the casing, create recesses within which each of the keys and associated visual displays are positioned.

The keyboard retainer 17 and its associated cutouts 18 and partition walls 21 and 22 are so formed as to provide for the receipt of keys 19 and visual displays 20 in a configuration of three columns and twleve rows. Additionally, above the uppermost row, the keyboard retainer 17 is so configured as to provide for the receipt of two additional keys 19 and visual displays 20.

The keys 19 and visual displays 20 are interconnected to the printed circuit board 16 in solid electrical contact therewith. During assembly, the printed circuit board 16 is first positioned within the casing 10 and thereafter, the keyboard retainer 17 positioned downwardly over the keys 19 and visual displays 20.

The printed circuit board 16 includes 38 identical circuits for interconnection to the 38 keys 19 and their associated visual displays 20. One such circuit is shown in FIG. 6 of the drawings and it is not necessary to show the remaining 37 such circuits.

Figure 6:
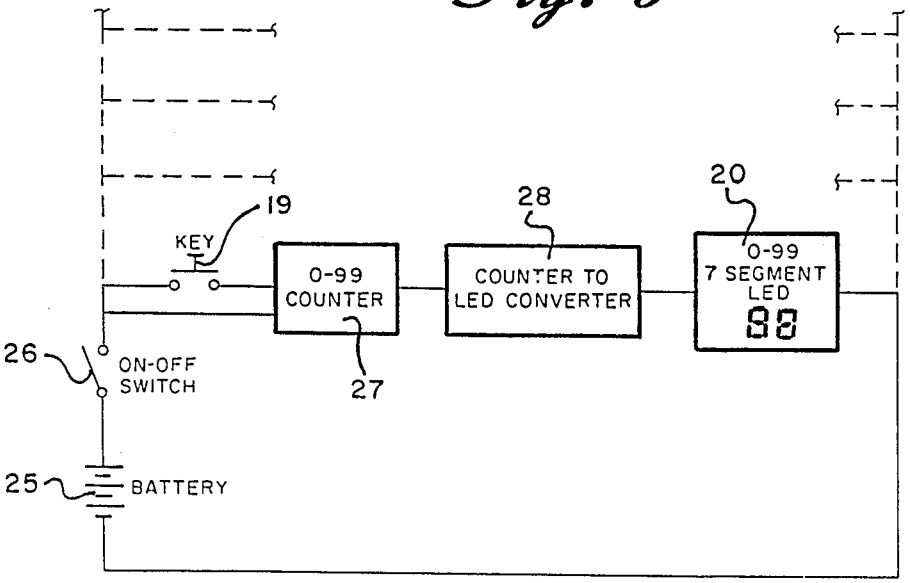
FIG. 6 is a block schematic diagram of the electronic circuitry of the roulette calculator of the present invention.

Referring now to FIG. 6 of the drawings, the printed circuit board is interconnected to a power supply or battery 25. The positive side of the battery is interconnected through an on/off switch 26 to each of the 38 keys 19 and to a 0–99 counter 27.

Each key 19 is interconnected to the counter 27. Upon the on/off switch being opened and then closed, the counter 27 will reset to 0. Upon the depression of the key 19, the counter 27 will advance to a binary expression for the Arabic numeral 1. A further depression of the key 19 will advance the counter 27 to the next binary expression for the Arabic numeral 2 and so on to the limit of Arabic 99 for the counter.

The counter 27 passes its binary expression to a counter to LED (light emitting diode) converter 28. The converter 28 receives the binary expression from the counter and converts it into a signal which is applied to the visual display 20. The visual display 20 is a seven segment light emitting diode device capable of displaying Arabic numerals from 0 to 99. The output signal from the counter 27 is so configured that when the counter has been reset to 0, it will cause the converter 28 to create a signal that will turn off the seven segment light emitting diode 20.

The numbering and color of the 38 keys in the three columns and twelve rows are identical to the color, numbering and layout of the roulette playing table. For example, number 1 is in the upper left hand corner and is colored red, adjacent to number 1 in the row is the key number 2 which is black and so on.

Figure 2:
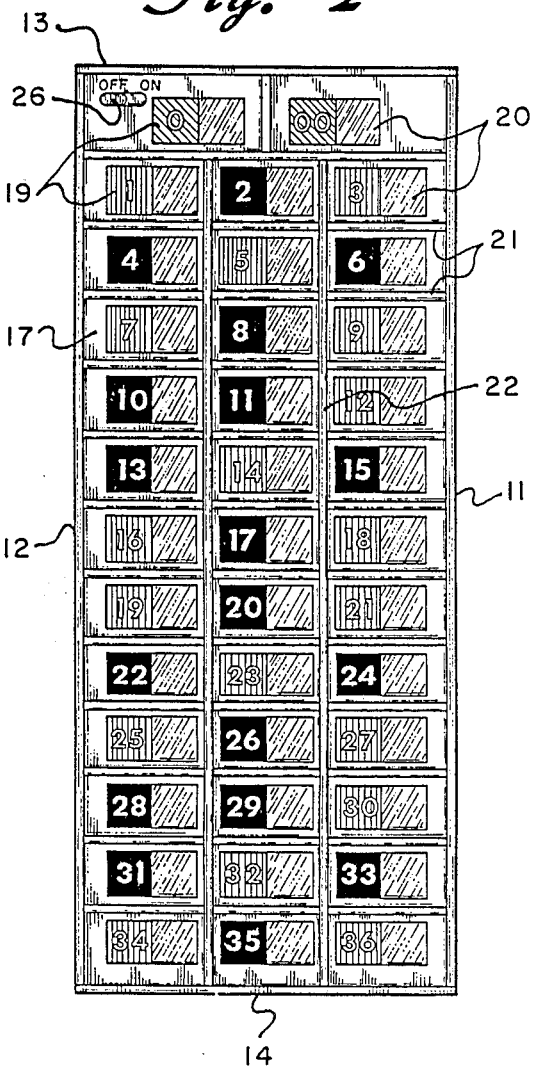
FIG. 2 is a plan view of the roulette calculator of the present invention.

The two keys positioned above the top row are colored green and include the indicia of 0 for the left hand key and 00 for the right hand key as shown in FIGS. 1 and 2. In this configuration, these keys likewise correspond to the numbers 0 and 00 as in the roulette playing table layout.

Figure 3:
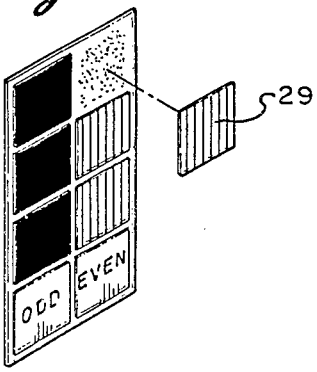
FIG. 3 is a perspective view of stick on decals used with the roulette calculator of the present invention.
Figure 4:
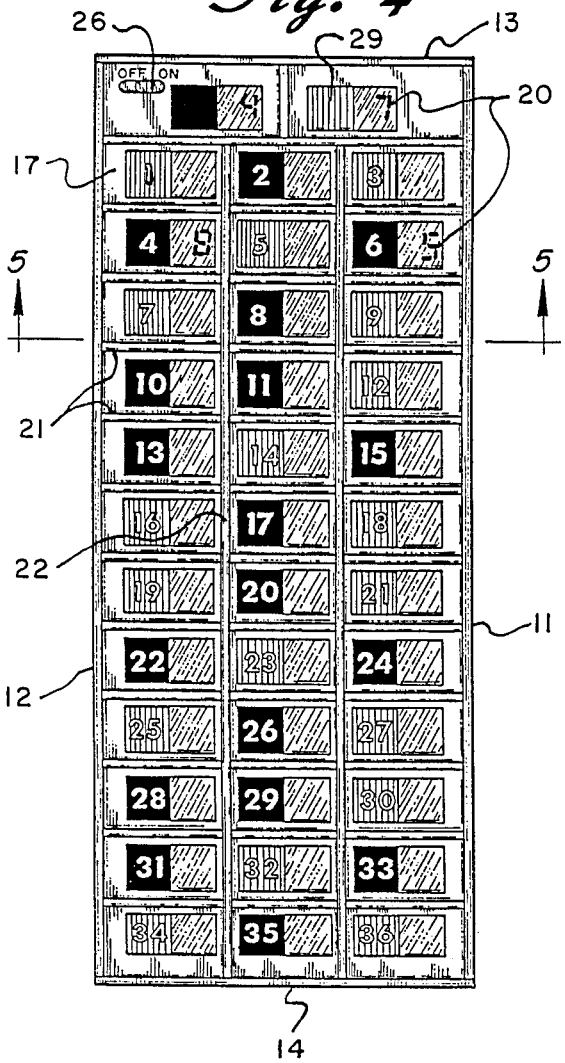
FIG. 4 is a plan view of the roulette calculator of the present invention illustrating illuminated visual displays.
Figure 5:
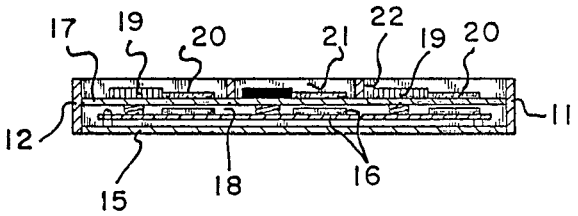
FIG. 5 is a sectional view taken along the line 5—5 of FIG. 4.

In accordance with the present invention, removable decals 29 are provided as shown in FIG. 3 of the drawings. These removable decals may be of the colors red and black or bear the nomenclature of odd and even. These decals of either color or of the indicia of odd and even may be placed over the keys above the top row as shown in FIG. 4 wherein the colors black and red have been placed over these keys.

In use, the calculator is turned off and then on to reset all displays 20 to 0 which is a nonilluminated state. Thereafter, as the roulette game progresses, the user enters each winning number as that number arises by depressing the particular key representing that number. As the play progresses, the user then need only glance at the calculator to ascertain what numbers have been winning numbers and how many times that number has been a winning number.

Where the user has not used the decals 29, then the numbers 0 and 00 are entered as they arise as winning numbers. If desired, the user can place upon these two keys above the upper row either the colors red and black or the indicia of odd and even. In this manner, the user may keep track of the number of times red and black was the winner or the number of times an odd number or an even number was the winner.

As the user continues to play the roulette game, he can determine patterns of winning numbers, conditions, i.e. odd and even, or colors. In this manner, the player then can adjust his betting in accordance with the pattern. At any particular time after which the pattern appears to have been broken, then the user can reset the calculator back to 0 and again start entering information to determine the emergence of a given pattern or patterns.

The roulette calculator of the present invention has been described in respect to a particular embodiment thereof set forth in the specification and as shown in the drawings. In view of the foregoing specific embodiment thereof, other variations and modifications of the concept of the invention may be suggested and therefore, the scope of the invention is not intended to be limited by the specific disclosure thereof but is to be interpreted in accordance with the appended claims.

What is claimed is:

1. A roulette calculator for recording and visually displaying the occurrence and number of winning numerals during the progress of play of the roulette game comprising:

a display board including a keyboard having a plurality of keys laid out in the format of a roulette playing table and the respective keys thereof numbered corresponding to a roulette playing table;

visual display means adjacent each key of the keyboard adapted to visually display numerals from zero to a finite number; and count indication and advancing means operatively coupled to said keyboard keys and said visual display means for advancing and continuously displaying the count of a given visual display numeral associated with a respective key one integer for each successive key stroke of said respective key on said keyboard.

2. The roulette calculator of claim 1 wherein the keyboard is a mechanical keyboard, the visual display means is an electronically powered lighted visual display and the count indication and advancing means are electronic circuit means.

3. The roulette calculator of claim 2 wherein the electronic circuit means does not illuminate a visual display until the count of one whereby nonwinning numbers will be evident by reason of nonillumination.

4. The roulette calculator of either of claims 1 or 3 wherein each key of the keyboard is positioned within a recess to guard against missed keying.

5. The roulette calculator of either of claims 1 or 3 wherein the keyboard layout and color of the keys corresponds to the layout and color of a roulette playing table.

6. The roulette calculator of either of claims 1 or 3 further including two additional keys and associated lighted visual displays; and removable decal means adapted to be positioned upon each key and coded to represent conditions such as red, black or odd, even.

* * * * *